US008109537B2

(12) United States Patent
Raming

(10) Patent No.: US 8,109,537 B2
(45) **Date of Patent: *Feb. 7, 2012**

(54) LINERLESS PACKING AND SHIPPING LABEL SYSTEM

(75) Inventor: Bruce Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 519 days.

This patent is subject to a terminal disclaimer.

(21) Appl. No.: 12/338,619

(22) Filed: Dec. 18, 2008

(65) Prior Publication Data

US 2010/0156087 A1 Jun. 24, 2010

(51) Int. Cl.
*G09F 3/10* (2006.01)

(52) U.S. Cl. ..... 283/81; 40/638

(58) Field of Classification Search ..... 40/638, 40/674; 283/79, 81

See application file for complete search history.

(56) References Cited

U.S. PATENT DOCUMENTS

| | | | | |
|---|---|---|---|---|
| 2,690,104 | A | 9/1954 | Schwartz et al. | |
| 3,226,862 | A | 1/1966 | Gabruk | |
| 3,315,387 | A | 4/1967 | Heuser | |
| 3,524,271 | A | 8/1970 | Buske | |
| 3,817,157 | A | 6/1974 | Andresen, Jr. | |
| 3,822,492 | A | 7/1974 | Crawley | |
| 3,986,440 | A | 10/1976 | Macdonald et al. | |
| 4,368,903 | A | 1/1983 | Jones | |
| 4,544,590 | A | 10/1985 | Egan | |
| 4,614,361 | A | 9/1986 | Foster | |
| 4,927,179 | A | 5/1990 | Ehret et al. | |
| 4,928,875 | A | 5/1990 | Hutchinson | |
| 4,940,258 | A | 7/1990 | Cuba, Jr. et al. | |
| 4,953,780 | A | 9/1990 | Ross | |
| 5,133,827 | A | 7/1992 | Raterman | |
| 5,232,248 | A | 8/1993 | Talbott | |
| 5,242,365 | A | 9/1993 | Counts et al. | |
| 5,289,972 | A | 3/1994 | Sauerwine et al. | |
| 5,370,420 | A | 12/1994 | Khatib et al. | |
| 5,413,383 | A | 5/1995 | Laurash et al. | |
| 5,425,823 | A | 6/1995 | Woodside, III | |
| 5,427,029 | A | 6/1995 | Dumke | |
| 5,476,698 | A * | 12/1995 | Denny | 428/41.9 |
| 5,484,170 | A | 1/1996 | Hatfield, Jr. | |
| 5,547,227 | A | 8/1996 | Laurash et al. | |
| 5,639,125 | A | 6/1997 | Garrison | |
| 5,653,472 | A | 8/1997 | Huddleston et al. | |
| 5,686,159 | A | 11/1997 | Langan | |
| 5,700,998 | A | 12/1997 | Palti | |

(Continued)

OTHER PUBLICATIONS

Office Action from U.S. Appl. No. 10/840,739 (dated Oct. 21, 2011).

*Primary Examiner* — Joanne Silbermann
*Assistant Examiner* — Kristina N Junge
(74) *Attorney, Agent, or Firm* — Hovey Williams LLP

(57) ABSTRACT

A linerless duplex label system is operable to print and apply a linerless duplex label to a substrate. A plurality of linerless duplex labels are provided and each label includes a single-ply stock with top and bottom faces. The label also includes an endless adhesive border applied to the bottom face. The label is configured so that multiple labels can be removably adhered to each other by the adhesive border, with at least one linerless duplex label being removably overlaid onto at least one other duplex label.

10 Claims, 6 Drawing Sheets

U.S. PATENT DOCUMENTS

| | | | |
|---|---|---|---|
| 5,716,688 | A | 2/1998 | Burke et al. |
| 5,730,469 | A | 3/1998 | Heimerdinger et al. |
| 5,735,549 | A | 4/1998 | Konkol et al. |
| 5,771,657 | A | 6/1998 | Lasher et al. |
| 5,893,512 | A | 4/1999 | Diedrich |
| 5,931,098 | A | 8/1999 | Bates |
| 5,940,305 | A | 8/1999 | Wurz |
| 5,951,053 | A | 9/1999 | Petkovsek |
| 5,984,778 | A | 11/1999 | Murphy |
| 6,080,094 | A | 6/2000 | Dahlquist |
| 6,110,554 | A | 8/2000 | Moeller et al. |
| 6,152,357 | A | 11/2000 | Schnitzer |
| 6,186,554 | B1 | 2/2001 | Raming |
| 6,213,518 | B1 | 4/2001 | Raming |
| 6,224,110 | B1 | 5/2001 | Ambridge et al. |
| 6,273,986 | B1 | 8/2001 | Egan |
| 6,317,648 | B1 | 11/2001 | Sleep et al. |
| 6,325,877 | B1 | 12/2001 | Murphy |
| RE37,521 | E | 1/2002 | Laurash et al. |
| 6,419,782 | B1 | 7/2002 | Johnson et al. |
| 6,428,640 | B1 | 8/2002 | Stevens et al. |
| 6,616,189 | B2 | 9/2003 | Raming |
| 6,761,791 | B2 | 7/2004 | Arway et al. |
| RE38,976 | E | 2/2006 | Raming |
| RE39,100 | E | 5/2006 | Raming |
| 7,475,912 | B1 * | 1/2009 | Reffett ..... 283/81 |
| 7,923,089 | B1 * | 4/2011 | Valenti et al. ..... 428/40.1 |
| 2011/0061802 | A1 * | 3/2011 | Raming ..... 156/256 |

* cited by examiner

LINERLESS PACKING AND SHIPPING LABEL SYSTEM

BACKGROUND

1. Field

The present invention relates generally to business forms. More specifically, the present invention concerns a linerless duplex label and package labeling method for providing packing and shipping information for a package.

2. Discussion of Prior Art

Many types of business forms are designed to be adhesively attached to a substrate, such as a product or a product container. For instance, packing and shipping labels are often adhered directly to a box, envelope, or other packaging for shipping a product. Conventional packing and shipping labels are provided as separate labels for each shipping package, with the packing label normally being held by the shipping label so that the contents indicia printed on the packing label are hidden from view. Some prior art shipping labels have been produced in the form of a duplex printed label with shipping indicia on one side and package contents indicia on the other side, and these labels are printed by a conventional duplex printer. The duplex label is also affixed to the package so that the contents indicia is hidden.

Conventional adhesive business forms, including adhesive packing and shipping labels, suffer from various undesirable limitations. For example, adhesive duplex shipping labels are deficient because they involve the use of a label stock, an adhesive pattern on the label stock, and a liner that covers the adhesive pattern when both sides of the duplex label are printed. When the printed label is ready to be applied to a substrate, a portion of the liner is typically removed from the label stock to expose the adhesive and the removed portion of the liner is typically discarded as waste. Thus, where the liner is discarded, the use of a large number of labels generates an undesirable amount of liner waste, and results in an inefficient label application process. Furthermore, the liner is problematic to remove from the duplex label stock using conventional automated label printing and application equipment. Yet further, traditional duplex labels (with portions of the liner being retained on the label for use) have a fairly complex construction and can present a fairly "thick" label construction that can present printing complications.

SUMMARY

Embodiments of the present invention provide a linerless duplex label system that does not suffer from the problems and limitations of the prior art business forms set forth above.

A first aspect of the present invention concerns a linerless duplex label operable to be applied to a package to provide packing and shipping information for the package. The linerless duplex label broadly includes an unfolded single label ply and an adhesive layer. The unfolded single label ply includes a central portion and an endless border portion surrounding the central portion. The central and border portions cooperatively present opposite top and bottom faces of the single label ply. The top face is operable to receive package address indicia and the bottom face is operable to receive package contents indicia within the central portion thereof. The adhesive layer is applied to the bottom face of the single label ply along the border portion of the single label ply, with the border portion of the single label ply operable to be flatly adhered to the package by the adhesive layer so that the label ply is affixed to the package in an unfolded condition. The adhesive layer presents an inner adhesive edge that defines an endless boundary line between the central and border portions, with the central portion being devoid of adhesive and thereby printable so as to receive the contents indicia thereon. The adhesive layer permits removable adhesion of overlaid linerless duplex labels to one another by adhering the top face of one label to the bottom face of another label.

A second aspect of the present invention concerns a linerless duplex label roll operable to provide packing and shipping labels for packages. The linerless duplex label roll broadly includes a continuous web of a single ply substrate wound in a roll. The single ply substrate presents a plurality of end-to-end duplex labels each including an unfolded single label ply including a central portion and an endless border portion surrounding the central portion. The central and border portions cooperatively present opposite top and bottom faces of the single label ply. The top face is operable to receive package address indicia and the bottom face is operable to receive package contents indicia within the central portion thereof. The linerless duplex labels each include an adhesive layer applied to the bottom face of the single label ply along the border portion of the single label ply, with the border portion of the single label ply operable to be flatly adhered to the package by the adhesive layer so that the label ply is affixed to the package in an unfolded condition. The bottom face of each label is removably adhered directly to the top face of at least one other label by the adhesive layer.

A third aspect of the present invention concerns a method of labeling a package with a linerless duplex label providing packing and shipping information for the package. The method broadly includes the steps of providing a plurality of overlaid linerless duplex labels each presenting opposite sides, one of which is provided with adhesive and the other which is devoid of adhesive, with at least one linerless duplex label overlying at least one other linerless duplex label and being removably adhered thereto; detaching the first-mentioned linerless duplex label from the at least one other linerless duplex label by adhesively removing the adhesive side of the first-mentioned linerless duplex label from the adhesive-free side of the at least one other linerless duplex label; printing address indicia on the adhesive-free side of the removed linerless duplex label; printing package contents indicia on the adhesive side of the removed linerless duplex label; and adhering the removed linerless duplex label to the package in a flat unfolded condition by positioning the adhesive side in adhesive engagement with the package.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a top view of a linerless duplex label that is part of a linerless duplex label system constructed in accordance with a first preferred embodiment of the present invention, showing a single-ply label stock of the linerless duplex label with an endless border portion and a central portion, with perforation lines extending between the border and central portions and defining a tear strip removably connecting the portions, and a transparent release coating applied to a top face of the label stock, with exposed indicia printed on the top face;

Figure 5:
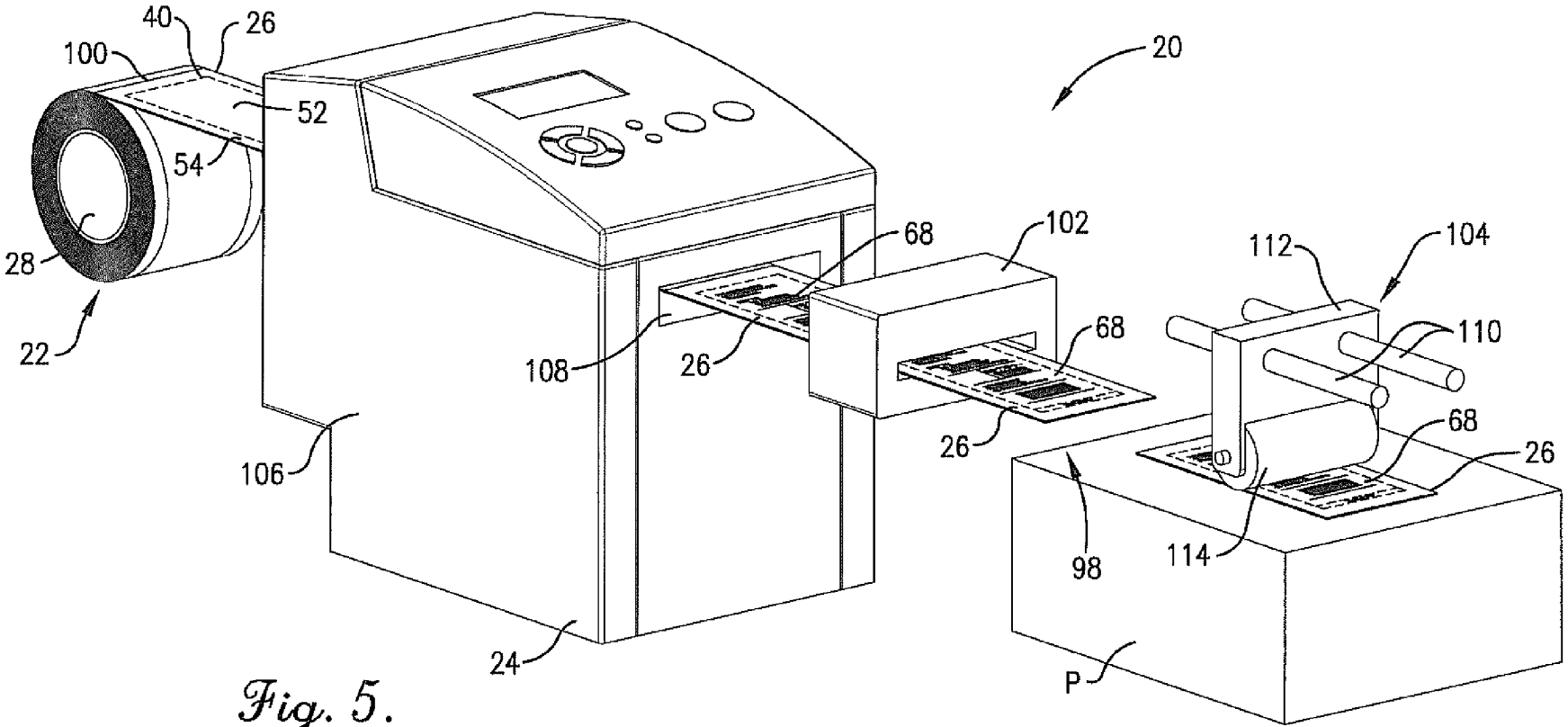
Figure 6:
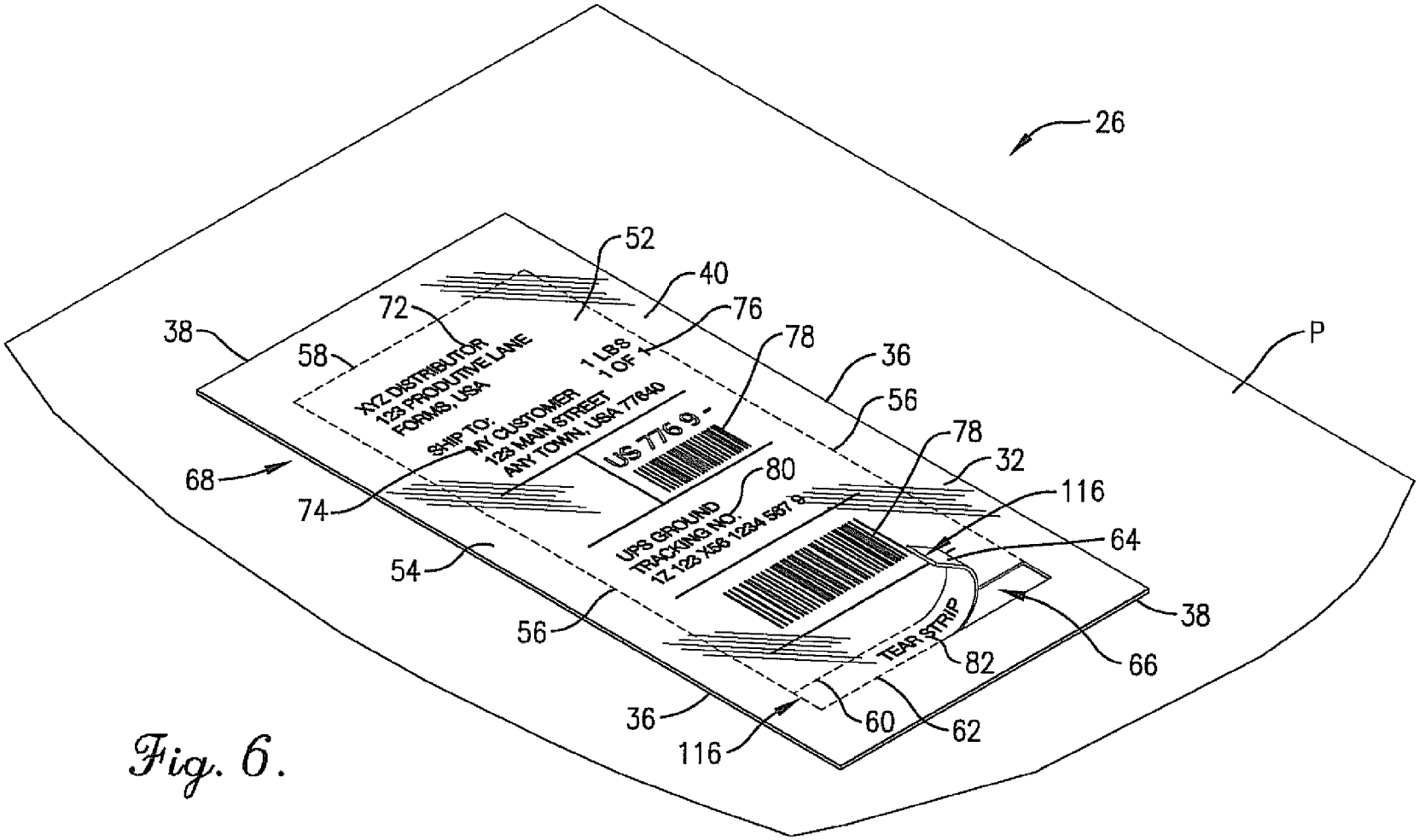
Figure 7:
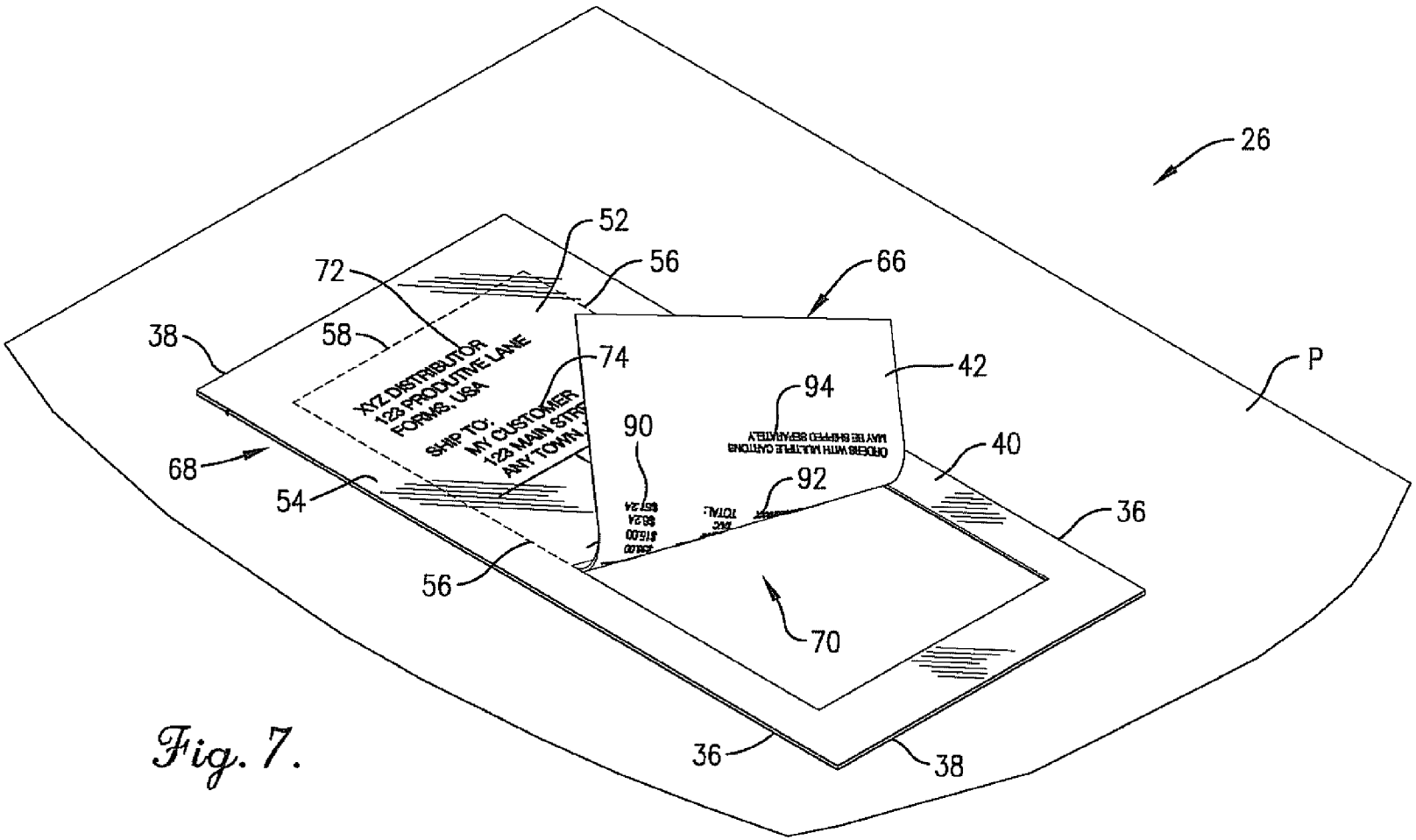
Figure 9:
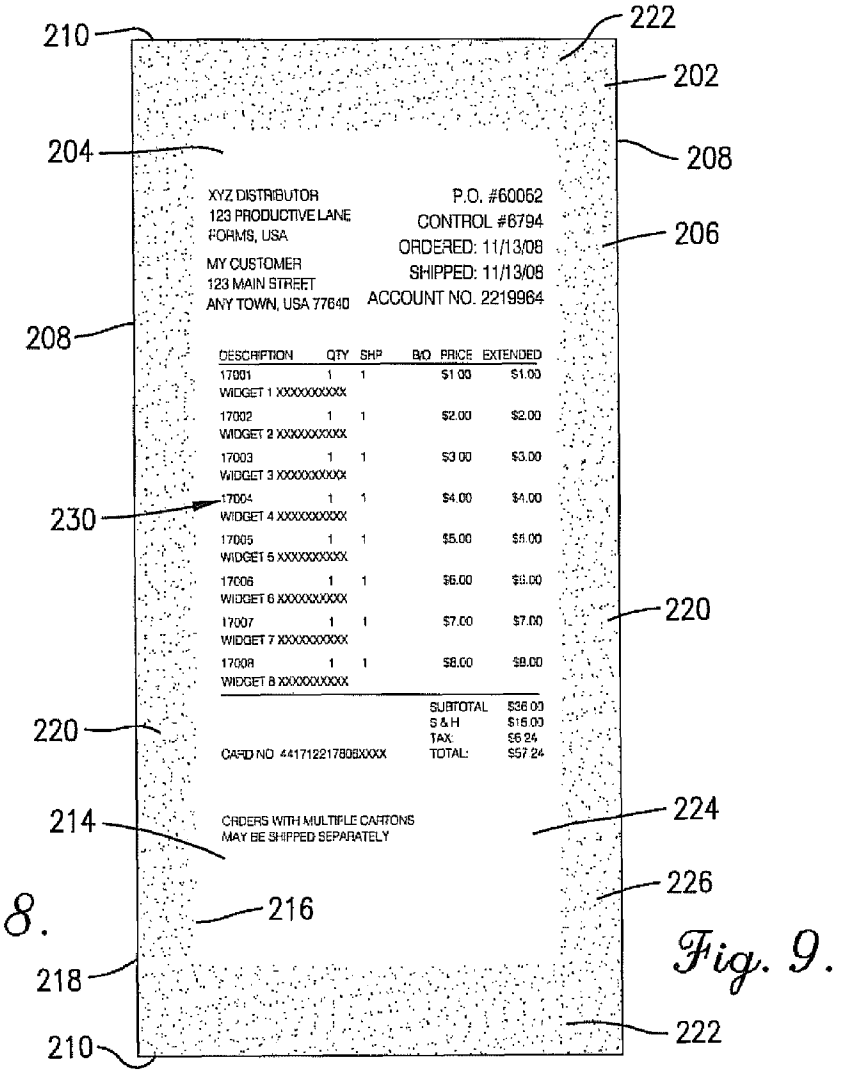
Figure 8:
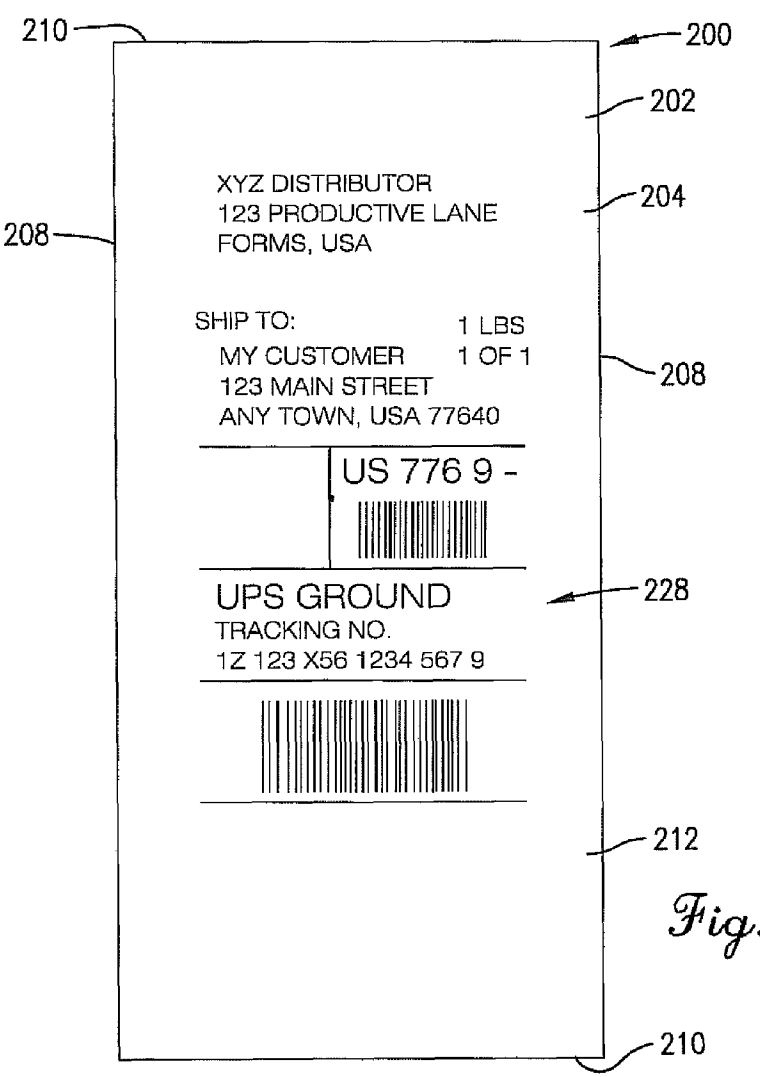

FIG. 5 is a top perspective view of the linerless duplex label system shown in FIGS. 1-4, with the system further including a duplex printer, a cutting mechanism, and a label applicator, and showing the system printing linerless duplex labels from the label roll, cutting the printed labels to detach an end-most label from the label roll, and applying the detached label to a package, with the central portion in a secured configuration;

FIG. 6 is a top perspective view of the linerless duplex label shown in FIGS. 1-5, showing the printed label adhered to the package and the central portion in an unsecured configuration where the tear strip is partly removed to present an unsupported margin of the central portion, with the central portion remaining attached to the border portion and the hidden indicia remaining substantially hidden;

FIG. 7 is a top perspective view of the linerless duplex label shown in FIGS. 1-6, showing the tear strip entirely removed from the adhered label and the central portion of the label partly removed from the border portion to expose the hidden indicia;

FIG. 8 is a top view of a linerless duplex label constructed in accordance with a second preferred embodiment of the present invention, showing a single-ply label stock of the linerless duplex label, with the top face of the label stock devoid of release coating; and FIG. 9 is a bottom view of the linerless duplex label shown in FIG. 8, showing an adhesive layer of the label applied to a bottom face of the label stock, with the adhesive layer being applied to define an endless border portion of the label stock and an adhesive-free central portion of the label stock surrounded by the endless border portion.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 2:
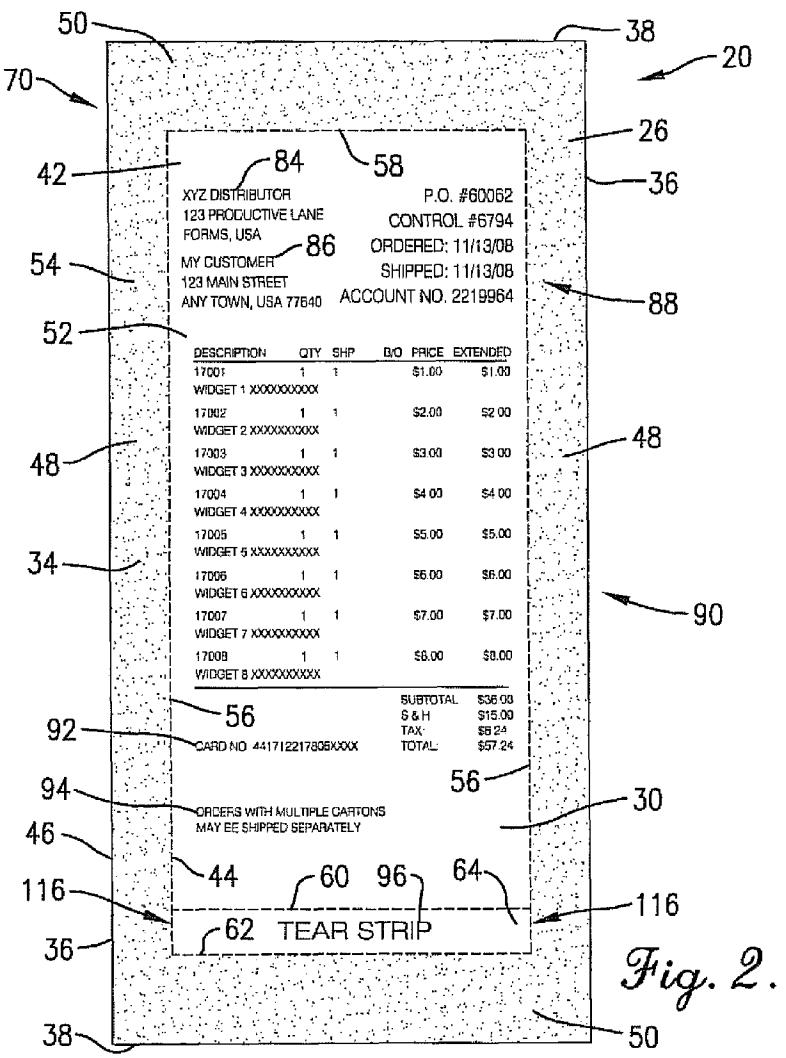
FIG. 2 is a bottom view of the linerless duplex label shown in FIG. 1, showing an adhesive layer of the label applied to a bottom face of the label stock, with the adhesive layer being applied to define the endless border portion of the label stock and the central portion of the label stock that receives hidden indicia.
Figure 1:
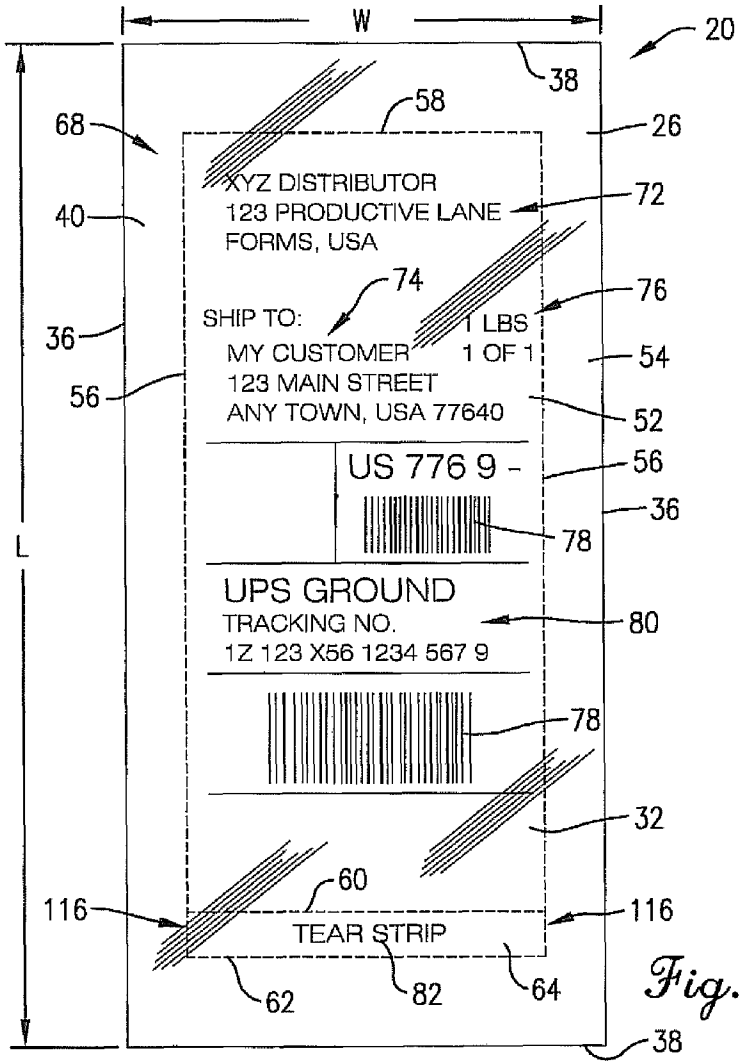
Figure 3:
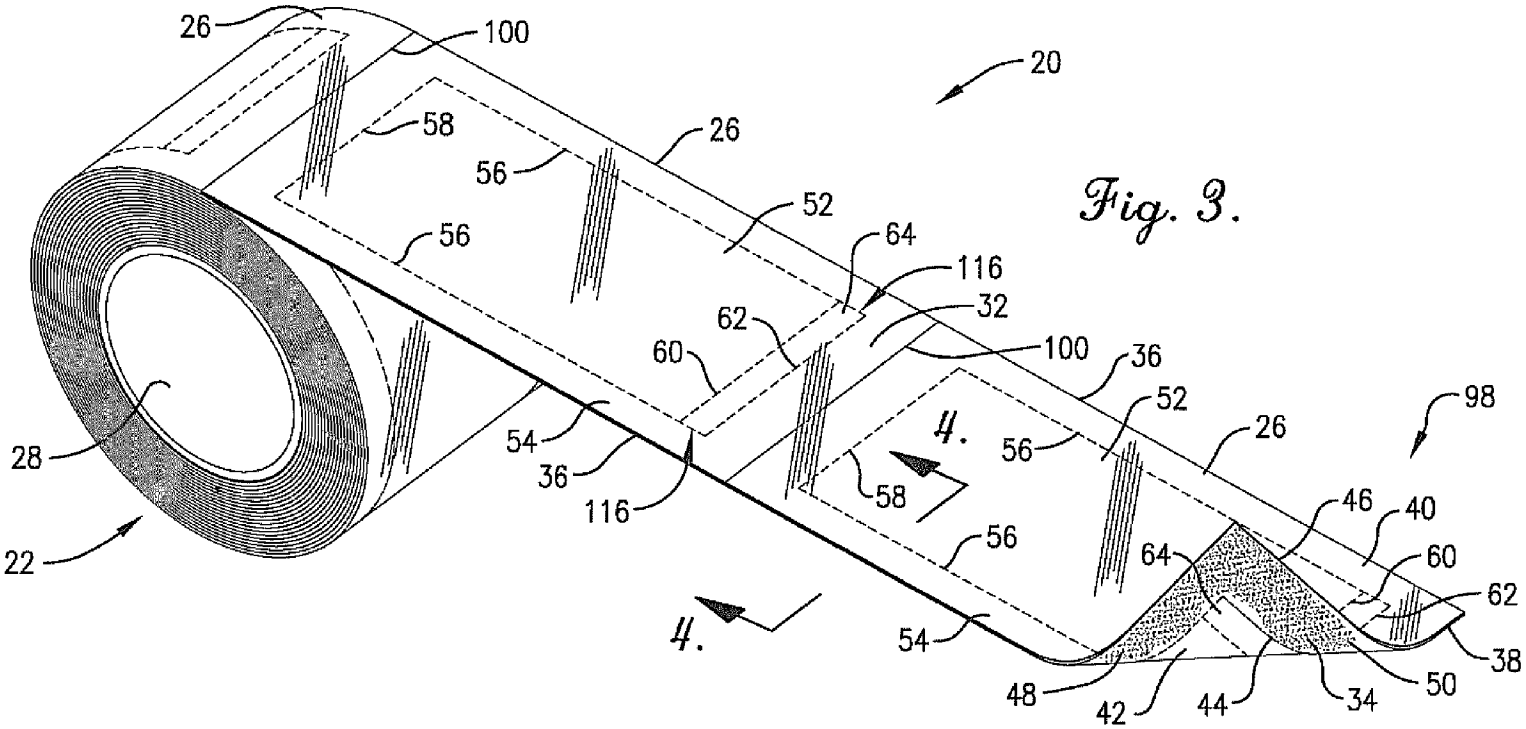
FIG. 3 is a perspective view of a plurality of the linerless duplex labels shown in FIGS. 1 and 2, showing a continuous web of single-ply label stock that presents a plurality of labels attached to end-to-end, with the continuous web being wound in a label roll, and showing the labels prior to being printed with the exposed and hidden indicia.
Figure 4:
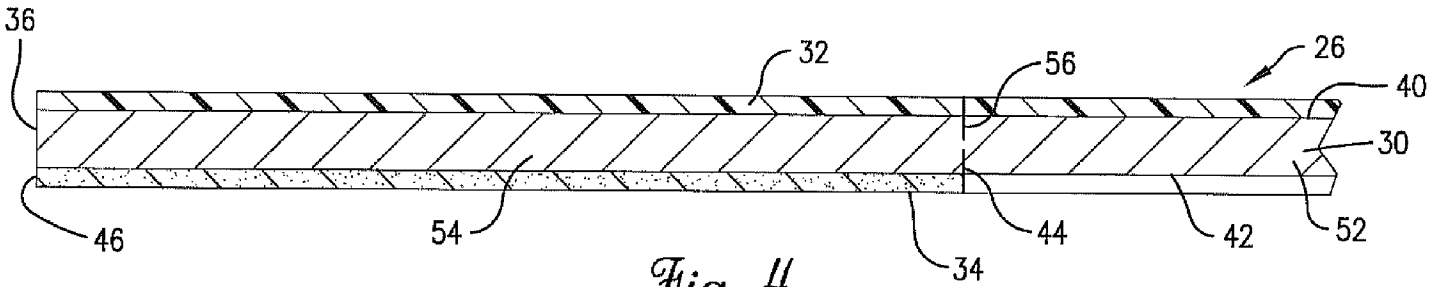
FIG. 4 is a fragmentary cross sectional view of the linerless duplex label taken along line 4-4 in FIG. 3, showing the label stock, release coating, and adhesive layer.

Turning initially to FIGS. 1 and 5, a linerless duplex label system 20 is constructed in accordance with a first preferred embodiment of the present invention. The label system 20 is configured to provide an adhesive duplex shipping and packing label for application on a package P. The linerless duplex label system 20 broadly includes a overlaid label supply 22 and a duplex printer 24.

Turning to FIGS. 1-4, the overlaid linerless label supply 22 is preferably in the form of a continuous roll, which provides a plurality of unprinted duplex labels for printing and application onto a substrate as a shipping and packing label. The label roll 22 includes a plurality of linerless duplex labels 26 attached end-to-end and a sleeve 28. In the preferred embodiment, the label roll 22 includes a continuous web of single-ply direct-thermal stock 30 (i.e., a label substrate) that presents the end-to-end linerless duplex labels 26, and the continuous web is wound in a roll onto the sleeve 28. As will be discussed further, the labels 26 are detachable from the label roll 22.

The linerless duplex labels 26 are each configured to receive packing and shipping information and broadly include thermal printer stock 30, release coating 32, and adhesive layer 34. The thermal printer stock 30 preferably comprises a single-ply direct-thermal stock, but other types of single-ply printer stock could be used without departing from the scope of the present invention. The preferred stock 30 includes opposite side edges 36 that define a substantially continuous width W thereof and opposite end edges 38 that define a length L thereof. Preferably, the width W is in the range of about 1 inch to about 8 inches and, more preferably, about 3 inches to about 5 inches. The length L preferably is in the range of about 1 inch to about 14 inches and, more preferably, about 6 inches to about 10 inches. The illustrated stock 30 also presents opposite top and bottom faces 40,42 that are printable by direct-thermal printing methods. However, the principles of the present invention are equally applicable where the stock 30 is configured to be printed using another printing method, e.g., thermal transfer printing, laser printing, or ink jet printing.

The release coating 32 serves to permit multiple labels 26 to be removably overlaid with one another, as will be discussed further. The release coating 32 preferably comprises a silicone coating applied in a continuous layer on the top face 40 of the thermal printer stock 30. Preferably, the layer of release coating 32 extends continuously to cover the entire top face 40. However, the release coating 32 could be alternatively configured without departing from the scope of the present invention. For instance, the release coating 32 could include a material other than silicone for providing a release mechanism. It is also within the scope of the present invention where the release coating 32 does not completely cover the top face 40. For example, the release coating could alternatively be print-applied within only the border portion (as defined below).

The adhesive layer 34 serves to adhere the label 26 to package P and is applied in an endless border pattern along the bottom face 42 to present inner and outer adhesive margins 44,46. The illustrated adhesive layer 34 preferably extends outwardly so that the outer adhesive margin 46 extends adjacent the edges 36,38 of the stock 30, with substantially no part of the bottom face 42 extending outwardly from the outer adhesive margin 46. This preferred arrangement reduces the risk of inadvertent label removal during shipping. However, the principles of the present invention are also applicable where part of the bottom face 42 extends outwardly from the outer adhesive margin 46, e.g., to provide an outer adhesive-free part of the label 26.

The illustrated adhesive layer 34 extends continuously inwardly from the outer adhesive margin 46 to present side borders 48 and end borders 50 of the endless border pattern, with the inner adhesive margin 44 extending endlessly along the borders 48,50. The inner adhesive margin 44 serves to define a central portion 52 of the stock 30 that is preferably adhesive-free along the bottom face 42, and an endless border portion 54 of the stock 30 that is substantially covered with adhesive along the bottom face 42. However, for some aspects of the present invention, adhesive could be applied to part of the central portion 52, e.g., to further adhere the label 26 to the package P.

Furthermore, the central portion 52 is configured to present a printable section of the bottom face 42 (i.e., the adhesive-free section of the bottom face 42), with the adhesive layer 34 preferably surrounding the central portion 52 to securely conceal the printable section when the label 26 is applied to package P. However, the principles of the present invention are applicable where another section of the bottom face 42 is printable (e.g., a section spaced outwardly from the adhesive layer 34). For some aspects of the present invention, some printing could be done on the adhesive layer 34 itself.

The illustrated adhesive layer 34 preferably comprises a permanent adhesive. As used herein, the term "permanent adhesive" refers to an adhesive that is operable to adhere the stock 30 to the package P or another substrate, with removal of at least part of the stock 30 from the package P resulting in physical damage to either the stock 30 or the package P, with the damage being visibly evident to the naked eye. In this manner, the use of permanent adhesive serves to make the applied label 26 tamper-evident. However, according to some aspects of the present invention (see below), the adhesive layer could alternatively be formed of a temporary adhesive, i.e., adhesive that permits label removal without visibly damaging the stock 30 or package P, is used. Furthermore, another mechanism could be used to cause the label 26 to be tamper-evident.

The label 26 further includes side perforations 56 and end perforations 58,60,62 that permit the label 26 to be separated into a removable center label section and a surrounding label section. In particular, the perforations 56,58,62 are preferably aligned with the inner adhesive margin 44 so that the removable center label section and the central portion 52 of the stock 30 are substantially co-extensive. Thus, the perforations 56,58,62 cooperatively provide an endless line of weakness that defines the central portion 52, with the central portion 52 being entirely removable from the endless border portion 54. However, for some aspects of the present invention, the central portion 52 may not be defined by perforations (e.g., where the label 26 is devoid of perforations 56,58,60,62, as will be shown in a subsequent embodiment depicted in FIGS. 8 and 9). It is also within the ambit of the present invention where the perforations 56,58,62 are spaced inwardly from the inner adhesive margin 44 (e.g., to ensure that no adhesive is applied to the removable center label section) or outwardly from the inner adhesive margin 44 (e.g., to permit limited adhesive engagement between the removable center label section and the package P when the label 26 is applied to the package P).

Perforation 60 extends along the central portion 52 between perforations 56 and is inwardly spaced from and adjacent to perforation 62. Perforations 56,60,62 cooperatively define a tear strip 64 of the central portion 52 that connects portions 52,54 of the stock 30 to each other. The illustrated tear strip 64 is removable to present an unsupported margin 66 of the central portion 52 adjacent an end of the label 26. The unsupported margin 66 permits a user to grab both faces 40,42 along the margin 66 and remove the central portion 46 from the endless border portion 48 by pulling the margin 66 in a direction toward the opposite end of the label 26. The illustrated tear strip 64 is preferably positioned at one end of the central portion 52, but could be alternatively positioned (e.g., along one side of the central portion 52) without departing from the scope of the present invention.

The printed label 26 includes top and bottom indicia 68,70 on respective top and bottom faces 40,42. As will be shown, the indicia 68,70 may include variable indicia (i.e., indicia that can vary with each label and associated package P) and non-variable indicia (i.e., indicia that generally does not change from label to label or from order to order). Furthermore, some of the indicia may be preprinted (e.g., before the single-ply substrate is wound into roll 22). The top indicia 68 presented on top face 40 includes sender address indicia 72, recipient address indicia 74, package size and package number indicia 76, bar code indicia 78 operable to provide a unique identifier associated with the package P that can be electronically scanned, package tracking indicia 80 operable to identify the carrier and a unique carrier tracking number associated with the package, and tear strip indicia 82. The top indicia 68 illustrated on the top face 40 is all printed on the central portion 52, but the principles of the present invention are applicable where at least some indicia is printed on the endless border portion 54. As will be discussed further, the top indicia 68 is generally exposed and visible when the label 26 is applied to the package P.

The bottom indicia 70 presented on the bottom face 42 includes sender address indicia 84, recipient address indicia 86, purchase order indicia 88 that includes a purchase order number, control number, customer account number, and order and ship dates of the purchase, package contents and billing indicia 90 that provides an itemized list of the package contents, the cost of each item listed alongside the corresponding item, the subtotal, shipping and handling cost, tax, and total cost, credit card indicia 92 including part of the customer's credit card number, order information indicia 94, and tear strip indicia 96. The bottom indicia 70 illustrated on the bottom face 42 includes information confidential to the sender and recipient. Therefore, the bottom indicia 70 is printed on the central portion 52 and is generally hidden from view when the label 26 is applied to the package P. However, the principles of the present invention are applicable where at least some indicia printed on the bottom face 42 is printed on another portion of the bottom face 42 (e.g., where part of the bottom face 42 extends outside of the adhesive border and is configured to receive printed indicia). Thus, some of the indicia on the bottom face 42 could be viewable without removing the applied label 26.

The top and bottom indicia 68,70 are preferably printed by direct-thermal printing, but each of the indicia 68,70 could be printed by other printing methods, such as thermal transfer, laser, ink jet printing, or a combination of printing methods. It is also within the scope of the present invention where the top indicia 68 is printed by one printing method and the bottom indicia 70 is printed by a different printing method. For instance, one of the indicia 68,70 could be printed by direct-thermal printing and the other one of the indicia 68,70 could be printed by thermal transfer printing. Also, one of the indicia 68,70 could be printed by ink jet printing and the other one of the indicia 68,70 could be printed by direct-thermal printing.

The indicia 72,82,84,96 generally comprise non-variable indicia. Indicia 74,76,78,80,86,88,90,92 generally includes variable indicia. Thus, both faces of the label 26 include variable indicia, and variable indicia on both faces of the label 26 can be associated with a particular order for the contents of package P. As will be discussed further, in printing indicia on both label faces, the indicia on the top face 40 can be matched with the indicia on the bottom face 42 to provide all of the indicia associated with the corresponding order. This facilitates proper shipment of the correct items to the correct recipient.

The illustrated label 26 is configured so that confidential indicia, such as the package contents indicia 90 and credit card indicia 92, is only located on the bottom face 42 along the central portion 52 and is thereby hidden when the label 26 is applied to package P. Thus, the label 26 must be at least partly removed from the package P to access the confidential indicia. Due to this tamper-evident label construction, the label 26, the package P, or both are visibly damaged when the label 26 is at least partly removed from the package P.

The top and bottom indicia 68,70 comprise the only information associated with the package P that is carried by the illustrated label 26 for visual and electronic identification (by the sender, distributor, or recipient) of the package P and the associated order. But it is also within the ambit of the present invention where the label 26 includes other package or order identification features, e.g., other types of machine-readable features. For instance, the label 26 could include an RFID tag attached to the stock 30 that can carry information in electronic form and can be electronically programmed and read.

The labels 26 are attached end-to-end to form the continuous web, and the web is wound to form the roll 22. In particular, the labels 26 are arranged so that the top and bottom faces 40,42 each extend continuously along the length of the web. Thus, the web is mounted to the sleeve 28 with the adhesive bottom face 42 adhesively engaging the sleeve 28. As the web is wound to form the roll 22, the adhesive bottom face 42 of each label 26 engages and overlies the top face 40 of the underlying label 26 on the roll 22. The release coating 32 on the top face 40 permits removable adhesion between adjacent overlaid labels 26 on the roll 22 so that the labels 26 are removable from each other without becoming damaged. The end-most label 26, i.e., the label at an exposed end 98 of the web, can be removed from overlaid engagement with the label 26 therebelow and can be separated from the web at cue mark location 100 between itself and the adjacent label 26, as will be discussed.

Turning to FIG. 5, the linerless duplex label system 20 is configured to print and apply a duplex packing and shipping label to package P and includes the label roll 22, duplex printer 24, cutter 102, and label applicator 104. The duplex printer 24 is configured to print the label 26 in a single printing pass, as will be discussed. The duplex printer 24 includes a housing 106 that presents a form inlet (not shown) that receives the incoming web and a form outlet 108 through which the printed web is discharged from the printer 24. The duplex printer 24 includes upper and lower print heads (not shown) positioned within the printer housing for printing indicia on corresponding top and bottom faces 40,42. The label roll 22 is rotatably supported by a frame (not shown) adjacent the form inlet of the duplex printer 24.

As the web passes through the duplex printer 24, the top and bottom faces 40,42 may be printed by the duplex printer 24 either simultaneously or sequentially (e.g., by printing the bottom face 42 after printing the top face 40) during the single printing pass. The single printing pass may likely involve some back-and-forth movement of the label 26 as the label 26 is being printed (e.g., to permit printing of the label 26 by multiple print heads), but it is also within the scope of the present invention where the label 26 is fed continuously through the printer 24 at a constant speed during printing of the label 26.

The illustrated duplex printer 24 is preferably a direct-thermal printer, but the principles of the present invention are equally applicable where the printer 24 includes another type of print head, such as thermal transfer head, a laser head, or an ink jet head, or a combination of print head types. For instance, the printer 24 could have one type of print head that serves as the upper print head to print the top face 40 and another type of print head spaced below the upper print head and serving as the lower print head to print the bottom face 40. Furthermore, multiple types of print heads could be used to print either the top or bottom face 40. While all of the illustrated indicia on label 26 is printed by the printer 24 using direct-thermal printing, it is also within the scope of the present invention where at least some of the indicia on label 26 is printed using thermal transfer, laser, or inkjet printing. Furthermore, some of the indicia, particularly the non-variable indicia, could be pre-printed on the continuous web (i.e., prior to printing by the duplex printer 24).

As discussed above, the linerless duplex label system 20 is operable to print the label 26 on both faces 40,42 with variable indicia, such as recipient address indicia 74 and package contents and billing indicia 90. All of the variable indicia printed on label 26 is associated with the particular package P, the contents of the package P, and the recipient of the package. Therefore, the system 20 associates (or matches) all of the variable indicia for each label 26 prior to printing of the label 26. For example, the system 20 could include a computer (not shown) for compiling and associating the information for each label 26. The system 20 also provides printing instructions to the printer 24 so that the associated (or matched) indicia is printed on the same label 26. It is also within the scope of the present invention where only some portions of the variable indicia printed on the label 26 are associated with each other. Also, while the illustrated variable indicia is associated with the corresponding package P, some variable indicia could be associated by another type of association (e.g., the recipient address indicia 86 and the account number of the purchase order indicia 88 can be associated with the name of a recipient).

The cutter 102 comprises a conventional cutting mechanism for cutting the end-most label 26 from the rest of the continuous web. The cutter 102 includes a housing and a cutting blade (not shown). The illustrated cutter 102 includes a sensor (not shown) that identifies when the cue mark location 100 reaches the blade, with the cutter 102 then shifting the blade to make a transverse cut along the cue mark location 100 to separate the end-most label 26 from the web. However, it is also within the scope of the present invention where the cutter 102 is operable to make a cut along the location 100 without sensing a cue mark. For instance, the system 20 could be programmed to feed the continuous web a predetermined length and then cut the label 26 to the predetermined length, with the system 20 being operable to cut multiple labels 26 to the same predetermined length. The illustrated cutter 102 is mounted externally to the printer 24, but could be an integral component of the printer 24 without departing from the scope of the present invention. Furthermore, cutting of the end-most label 26 could occur before or after printing of either face 40,42. While the end-most label 26 is preferably separated from the web by the cutter 102, it is within the scope of the present invention where the end-most label 26 is separated by another mechanism. For instance, the web could include a line of weakness extending along each location 100 and the labels 26 could be separated by a mechanism that bursts or tears the web along the line of weakness.

The label applicator 104 includes a conventional roller applicator and includes a frame 110, a roller head 112, and a roller 114 rotatably mounted on the head 112. The head 112 and roller 114 are operable to slide along the frame 110, with the roller 114 engaging a top surface of the package P. As the printed label 26 is machine-fed into a position adjacent the top surface of the package P, roller 114 rolls over the top face 40 of label 26 from one end to the other and thereby presses the label 26 onto the package P. The adhered label 26 is positioned in a secured configuration where the bottom indicia 70 is hidden and the central portion 52 is fully attached to the border portion 54 along the endless line of weakness formed by the perforations 56,58,62 to restrict exposure of the bottom indicia 70. Again, it is within the scope of the present invention where some indicia printed on the bottom face 42 can be viewed once the label 26 is applied to the package P and before the label 26 is removed (e.g., where indicia are printed on a flap of the endless border portion 54 spaced outwardly from the adhesive layer 34, with the flap operable to be shifted to expose the indicia). Furthermore, the label 26 is preferably adhered in a flat, unfolded condition. It has been found that applying the label 26 in a flat and unfolded condition on package P is preferable, particularly for packing and shipping labels, because the label 26 is resistant to inadvertent damage or removal caused by package handling and distribution. Importantly, the illustrated label 26 effectively resists damage caused by exposure to handling equipment of large-volume parcel shippers.

The illustrated system 20 is preferably configured to operate as an automatic label print and apply station that is electronically operated and can apply printed labels to a plurality of packages P. But the principles of the present invention are applicable where some steps of the label print and application process are performed manually. Because the system 20 is configured to print variable indicia on both label faces, the system 20 can also apply labels to a plurality of packages P, where each package P has at least some indicia that is different from the other packages P. For instance, the system 20 is operable to print and apply labels to multiple packages P, with each package having different contents and each label 26 having different package contents indicia. Similarly, the recipient address indicia is likely different between each package.

Turning to FIGS. 6 and 7, the central portion 52 of the applied label 26 is removable from the endless border portion 54 by initially separating the tear strip 64 from the portion 54. In particular, one end 116 of the tear strip 64 is grabbed and drawn by the user toward the other end 116 of the tear strip 64. The tear strip 64 can be either partly or completely removed, and this separation of the tear strip 64 leaves the label 26 in an unsecured configuration where the bottom indicia 70 is no longer securely concealed. Furthermore, the unsupported margin 66 of the central portion 52 is exposed to permit the user to grab the margin 66 on both faces 40,42. The margin 66 can then be drawn away from the endless border portion 54 to separate the central portion 52 from the endless border portion 54 to a greater degree and further enable viewing of bottom indicia 70, as shown in FIG. 8. The central portion 52 can also be completely detached from the endless border portion 54. In this instance, the detached central portion 52 serves as a packing slip that can be processed by the package recipient, e.g., to confirm that the contents ordered were actually shipped in the package, and can be saved as a record of the transaction.

In operation, the linerless duplex label system 20 is operable to efficiently apply packing and shipping labels to multiple packages while minimizing label waste and incidences of equipment failure. The label roll 22 dispenses the continuous web of labels 26 into the printer 24 by unrolling a label 26 from overlaid adhesion with another label 26. That is, an outer label 26 is unrolled from an adjacent inner label 26 by separating the adhesive face of the outer label 26 from the adhesive-free face of the inner label 26. Again, the illustrated labels 26 include no pre-printed indicia, although some pre-printed indicia may be included on the continuous web prior to printing with printer 24 if desired. As labels 26 pass from the form inlet to the form outlet 106 in a single printing pass, indicia 68,70 is printed on top and bottom faces 40,42. The printed labels 26 then pass out of the form outlet 108 and into the cutter 102 so that the end-most label 26 is separated from the rest of the continuous web. The separated label 26 is then positioned adjacent the package P, and the label applicator 104 adheres the label 26 onto the package P in a flat and unfolded condition. The bottom face 42 of the adhered label 26 is positioned in adhesive engagement with the package P, and the indicia 70 printed on the bottom face 42 is thereby hidden by the adhered label 26 and package P in a secured label configuration. In addition, the top face 40 is exposed to permit viewing and electronic scanning of indicia 68 printed thereon. The system 20 is configured to print and apply a plurality of labels 26 to corresponding packages P, with the indicia on each side of the label 26 being matched with each other and with the package P. The bottom indicia 70 printed along the central portion 52 is exposed for viewing by first removing the tear strip 64 from the portions 52,54 to present the unsupported margin 66. The recipient can then grasp the exposed margin 66 to remove the central portion 52 from the endless border portion 54, with the central portion 52 thereby serving as a packing slip.

Turning to FIGS. 8 and 9, an alternative linerless duplex label system 200 including an alternative linerless duplex label 202 is constructed in accordance with a second preferred embodiment of the present invention. For the sake of brevity, the remaining description will focus primarily on the differences of this embodiment relative to the embodiment illustrated in FIGS. 1-7.

The alternative linerless duplex label 202 is configured to receive packing and shipping information and broadly includes thermal printer stock 204 and adhesive layer 206. The thermal printer stock 204 comprises a single-ply direct-thermal stock and includes side and end edges 208,210. The illustrated stock 204 also presents opposite top and bottom faces 212,214 that are printable by direct thermal printing methods.

The adhesive layer 206 serves to adhere the label 202 to the package and is applied in an endless border pattern along the bottom face 214 to present inner and outer adhesive margins 216,218. The illustrated adhesive layer 206 extends continuously inwardly from the outer adhesive margin 218 to present side borders 220 and end borders 222 of the endless border pattern, with the inner adhesive margin 216 extending endlessly along the borders 220,222. The inner adhesive margin 216 serves to define a central portion 224 of the stock 204 that is preferably free of adhesive, and an endless border portion 226 of the stock 204 that is substantially covered with adhesive. The illustrated adhesive layer 206 comprises a temporary adhesive, i.e., adhesive that permits label removal without damaging the stock 30 or package P. The temporary adhesive permits each label 202 to be removed from overlaid adhesive engagement with one or more other labels 202 (e.g., when the labels 202 are wound onto a label roll). Moreover, the use of temporary adhesive permits removable adhesion between labels 202 with the top face 212 being devoid of release coating.

The central portion 224 is also configured to present a printable section of the bottom face 214, with the adhesive layer 206 preferably surrounding the central portion 224 to securely conceal the printable section when the label 202 is applied. The linerless duplex label 202 further includes top and bottom indicia 228,230 printed on the top and bottom faces 212,214. The bottom indicia 230 is printed on the printable section of the bottom face 214.

The label 202 is printed and applied to the package P similar to the process of printing and applying the label 26. The applied label 202 also is adhered to the package P so that the top indicia 220 is exposed and readily viewed and the bottom indicia 222 is cooperatively hidden from view by the label 202 and the package P. However, label 202 is devoid of any perforations or lines of weakness spaced within the edges

208,210. Thus, the use of temporary adhesive in the adhesive layer 206 permits the bottom indicia 230 to be exposed for viewing by separating the label 202 as a whole from the package P. Furthermore, the entire label 202 is completely detached from the package P to serve as a packing slip.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A labeled package assembly to be shipped to a recipient, said labeled package assembly comprising:

a package containing at least one item to be received by the recipient; and a linerless duplex label applied to the package, wherein opposite sides of the label carry publicly displayed package address indicia associated with the recipient and hidden package contents indicia listing the at least one item, respectively, said linerless duplex label including an unfolded single label ply and an adhesive layer, said unfolded single label ply including an outside margin, an endless line of weakness spaced completely from the outside margin, an endless border portion defined between the outside margin and the line of weakness, with the line of weakness defining a central portion surrounded by the border portion, said central and border portions cooperatively presenting opposite top and bottom faces of the single label ply, said top face carrying the package address indicia and said bottom face carrying the package contents indicia within the central portion thereof so that the central portion provides a packing slip, said adhesive layer applied to the bottom face of the single label ply along the border portion of the single label ply, said border portion of the single label ply being flatly adhered to the package by the adhesive layer so that the label ply is affixed to the package in an unfolded condition, with the label and package cooperatively concealing the package contents indicia as long as the label is adhered to the package, said adhesive layer presenting an inner adhesive edge that defines an endless boundary line between the central and border portions, with the central portion being devoid of adhesive and thereby printable so as to receive the contents indicia thereon, said adhesive layer permitting removable adhesion of overlaid linerless duplex labels to one another by adhering the top face of one label to the bottom face of another label.

2. The labeled package assembly as claimed in claim 1, said central and border portions being separable by the line of weakness, with the line of weakness extending adjacent the inner adhesive edge and permitting at least partial detachment of the central portion from the border portion.

3. The labeled package assembly as claimed in claim 2, said line of weakness being aligned with the inner adhesive edge and being endless to permit the central portion to be completely detached from the border portion.

4. The labeled package assembly as claimed in claim 2, said central portion including a removable tear strip removably connecting the central and border portions.

5. The labeled package assembly as claimed in claim 1, said adhesive comprising a permanent adhesive; and a release coating applied to the top face of the single label ply, with the release coating operable to permit removable adhesion of adjacent linerless duplex labels.

6. The labeled package assembly as claimed in claim 5, said release coating covering the top face of the single label ply.

7. The labeled package assembly as claimed in claim 5, said central and border portions being separable by the line of weakness, with the line of weakness extending adjacent the inner adhesive edge and permitting at least partial detachment of the central portion from the border portion.

8. The labeled package assembly as claimed in claim 7, said line of weakness being aligned with the inner adhesive edge and being endless to permit the central portion to be completely detached from the border portion.

9. The labeled package assembly as claimed in claim 7, said central portion including a removable tear strip removably connecting the central and border portions.

10. The labeled package assembly as claimed in claim 1, said single label ply comprising dual sided direct-thermal stock operable to be printed on top and bottom faces by direct-thermal printing.

* * * * *